US006193602B1

(12) United States Patent
Aprea

(10) Patent No.: US 6,193,602 B1
(45) Date of Patent: Feb. 27, 2001

(54) VENTILATOR FOR AIR CIRCULATION

(76) Inventor: Anthony J. Aprea, 84 Ryerson Ave., Manorville, NY (US) 11949

( * ) Notice: Subject to any disclaimer, the term of this patent is extended or adjusted under 35 U.S.C. 154(b) by 0 days.

(21) Appl. No.: 09/234,698

(22) Filed: Jan. 21, 1999

(51) Int. Cl.[7] ..... F24F 7/013
(52) U.S. Cl. ..... 454/208; 454/210
(58) Field of Search ..... 454/205, 207, 454/208, 210

(56) References Cited

U.S. PATENT DOCUMENTS 3,081,690 * 3/1963 Gesmar .
4,773,310 * 9/1988 Corwin .
5,190,496 * 3/1993 Shih-Chin ..... 454/210
5,382,136 * 1/1995 Wang ..... 416/247
5,660,605 * 8/1997 Chan et al. ..... 55/274
5,664,996 * 9/1997 Wang et al. ..... 454/210

* cited by examiner

*Primary Examiner*—Harold Joyce
*Assistant Examiner*—Andrea M. Joyce

(57) ABSTRACT

An air circulator unit with adjustable size is provided including a housing situated within a window frame. The housing includes a pair of halves each defining an interior space, an open front face and an open rear face. The housing further includes a length adjuster having a pair of ends coupled between the halves of the housing with a plurality of bellows formed therebetween for allowing the movement of the halves along a single axis. At least one fan unit is mounted within the interior space of each of the halves for directing air between the open faces of the housing.

17 Claims, 2 Drawing Sheets

FIG. 3
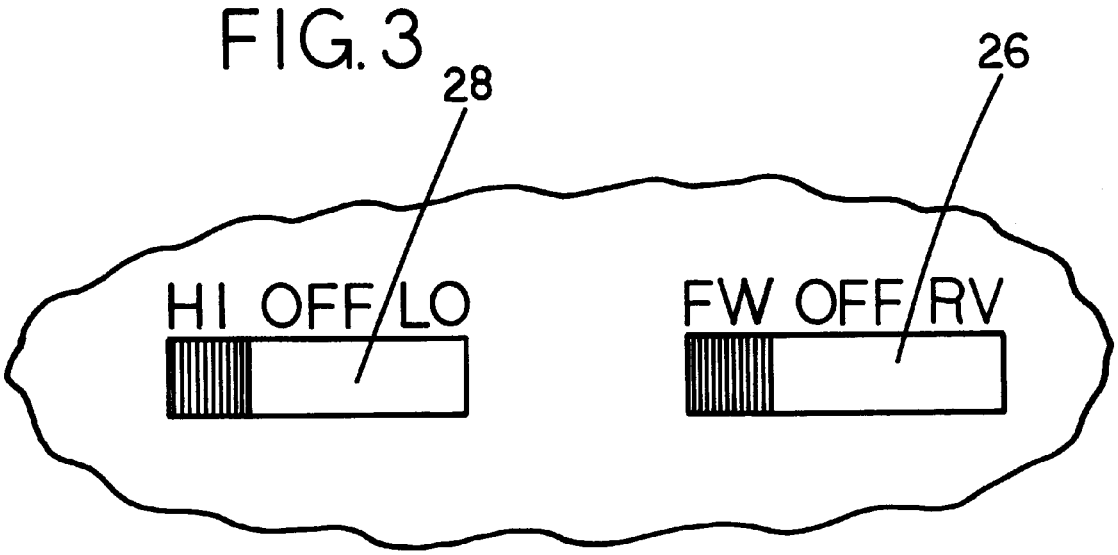
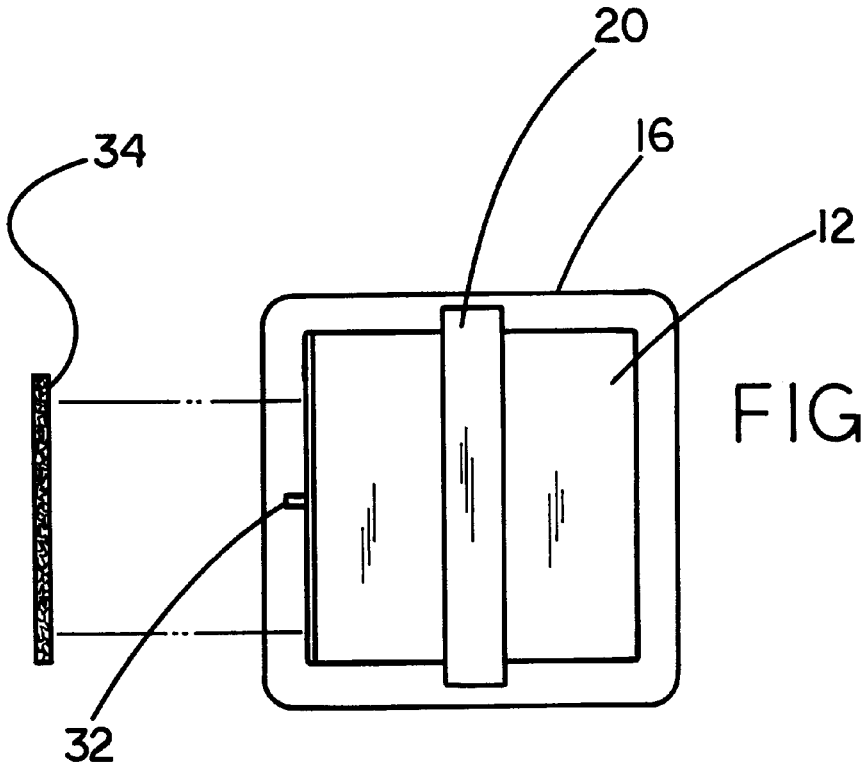
FIG. 4

VENTILATOR FOR AIR CIRCULATION

BACKGROUND OF THE INVENTION

1. Field of the Invention

The present invention relates to window-mounted air conditioners and more particularly pertains to a new smoke eliminator and air circulator for both removing smoke from a building and circulating air with a unit having an adjustable size.

2. Description of the Prior Art

The use of window-mounted air conditioners is known in the prior art. More specifically, window-mounted air conditioners heretofore devised and utilized are known to consist basically of familiar, expected and obvious structural configurations, notwithstanding the myriad of designs encompassed by the crowded prior art which have been developed for the fulfillment of countless objectives and requirements.

Known prior art window-mounted air conditioners include U.S. Pat. Nos. 5,382,136; 5,190,496; U.S. Pat. No. Des. 345,011; U.S. Pat. No. 5,334,091; U.S. Pat. No. Des. 346,441; and U.S. Pat. No. 4,872,399.

In these respects, the smoke eliminator and air circulator according to the present invention substantially departs from the conventional concepts and designs of the prior art, and in so doing provides an apparatus primarily developed for the purpose of both removing smoke from a building and circulating air with a unit having an adjustable size.

SUMMARY OF THE INVENTION

In view of the foregoing disadvantages inherent in the known types of window-mounted air conditioners now present in the prior art, the present invention provides a new smoke eliminator and air circulator construction wherein the same can be utilized for both removing smoke from a building and circulating air with a unit having an adjustable size.

The general purpose of the present invention, which will be described subsequently in greater detail, is to provide a new smoke eliminator and air circulator apparatus and method which has many of the advantages of the window-mounted air conditioners mentioned heretofore and many novel features that result in a new smoke eliminator and air circulator window-mounted air conditioners, either alone or in any combination thereof.

To attain this, the present invention generally comprises a housing having a pair of halves. Each half is equipped with a top face, a bottom face and a pair of end faces for defining an interior space, an open front face and an open rear face. As shown in FIGS. 1 & 2, the housing further includes a length adjuster having a pair of ends coupled to the end faces of the halves of the housing. The length adjuster has a plurality of bellows formed between its ends for allowing the movement of the halves along a single axis. Next provided is an elastomeric sealing strip mounted along a central extent of the top face, the bottom face and outer end face of each of the halves of the housing. The sealing strip serves for affording a seal between a window and a sill of a window frame. With continuing reference to FIGS. 1 & 2, a plurality of fan units are each mounted within the interior space of each of the halves in side-by-side relationship along parallel axes. Each fan unit includes a first slide switch mounted on a front edge of the top face of the associated halve of the housing. Ideally, the first slide switch is mounted above the corresponding fan unit. In a first orientation, the switch is adapted for directing air from the open front face to the open rear face. In a second orientation, the switch controls the associated fan unit such that air is directed from the open rear face to the open front face. It should be noted that the open rear face may be selectively closed when not in use. Finally, the flow of air is precluded in a third orientation. Each fan unit further includes a second slide switch adjacent to the first slide switch of the corresponding fan unit. as shown in FIG. 3. The third slide switch serves for controlling a speed at which the fan unit directs air. Finally, two sets of horizontally oriented vanes are each pivotally mounted between front edges of the end faces of one of the halves of the housing. Each set of vanes includes a lever mounted on the front edge of the outer end face of the corresponding halve of the housing. Such lever is connected to the vanes of the associated set for controlling the flow of air upwardly and downwardly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new smoke eliminator and air circulator apparatus and method which has many of the advantages of the window-mounted air conditioners mentioned heretofore and many novel features that result in a new smoke eliminator and air circulator window-mounted air conditioners, either alone or in any combination thereof.

It is another object of the present invention to provide a new smoke eliminator and air circulator which may be easily and efficiently manufactured and marketed.

It is a further object of the present invention to provide a new smoke eliminator and air circulator which is of a durable and reliable construction.

An even further object of the present invention is to provide a new smoke eliminator and air circulator which is susceptible of a low cost of manufacture with regard to both materials and labor, and which accordingly is then susceptible of low prices of sale to the consuming public, thereby making such smoke eliminator and air circulator economically available to the buying public.

Still yet another object of the present invention is to provide a new smoke eliminator and air circulator which provides in the apparatuses and methods of the prior art some of the advantages thereof, while simultaneously overcoming some of the disadvantages normally associated therewith.

Still another object of the present invention is to provide a new smoke eliminator and air circulator for both removing smoke from a building and circulating air with a unit having an adjustable size.

Even still another object of the present invention is to provide a new smoke eliminator and air circulator that includes a housing situated within a window frame. The housing includes a pair of halves each defining an interior space, an open front face and an open rear face. The housing further includes a length adjuster having a pair of ends coupled between the halves of the housing with a plurality of bellows formed therebetween for allowing the movement of the halves along a single axis. At least one fan unit is mounted within the interior space of each of the halves for directing air between the open faces of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a detailed view of the first and second slide switches of one of the fan units of the present invention.

FIG. 4 is an end view of the present invention.

DESCRIPTION OF THE PREFERRED EMBODIMENT

Figure 1:
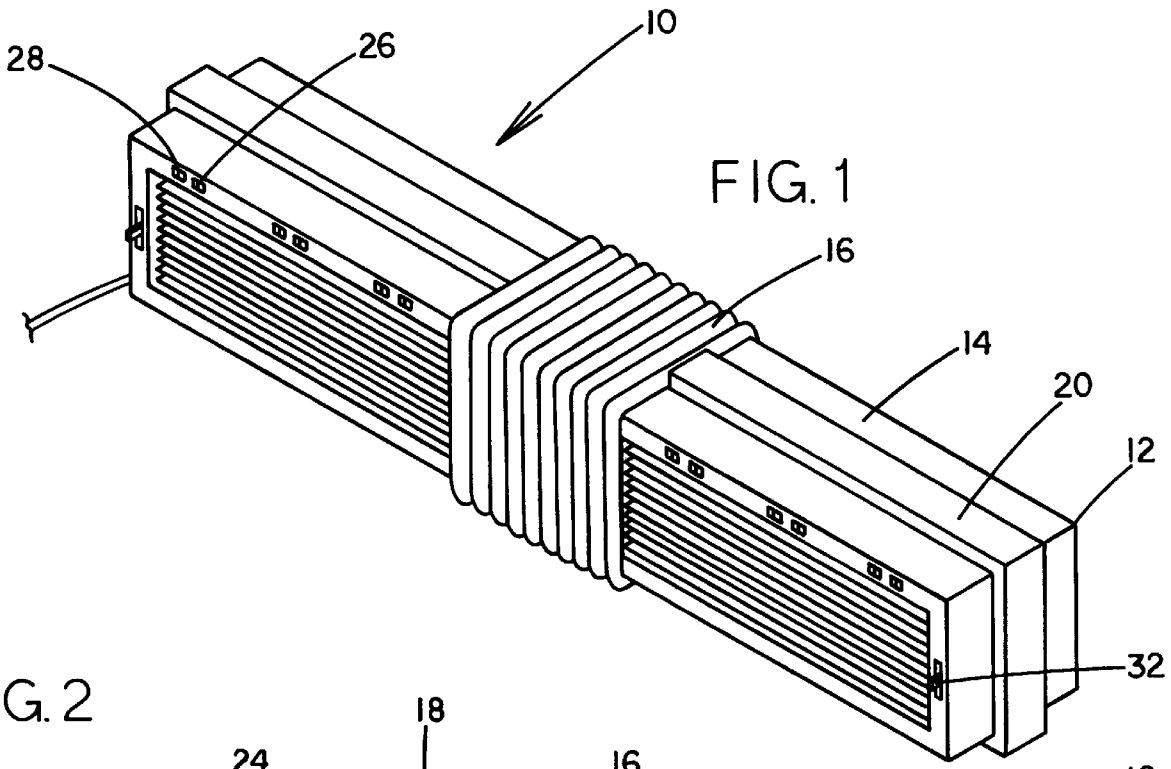
FIG. 1 is a perspective view of a new smoke eliminator and air circulator according to the present invention.

With reference now to the drawings, and in particular to FIGS. 1 through 4 thereof, a new smoke eliminator and air circulator embodying the principles and concepts of the present invention and generally designated by the reference numeral 10 will be described.

Figure 2:
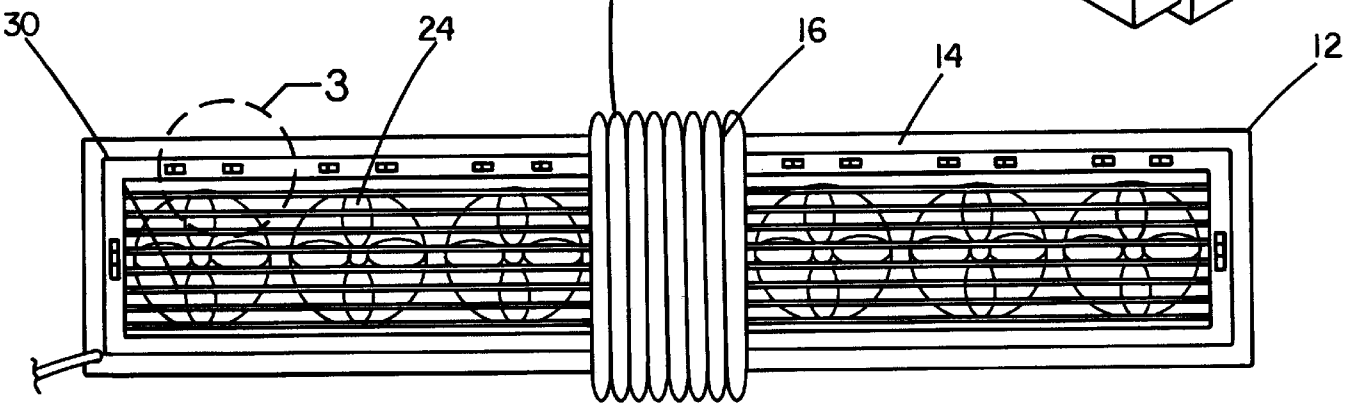
FIG. 2 is a front view of the present invention.

The present invention, designated as numeral 10, includes a housing 12 having a pair of equally sized halves 14. Each half is equipped with a top face, a bottom face and a pair of end faces for defining an interior space, an open front face and an open rear face. As shown in FIGS. 1 & 2, the housing further includes a length adjuster 16 having a pair of ends coupled to the end faces of the halves of the housing. The length adjuster is preferably hollow with a square lateral cross-section and has a plurality of bellows 18 formed between its ends for allowing the movement of the halves along a single axis. Ideally, a length of the housing is adjustable between 20–30 inches. As shown in FIGS. 1 & 2, the housing has a height which is equal to its depth and less than ¼ its length.

Next provided is an elastomeric scaling strip 20 mounted along a central extent of the top face, the bottom face and outer end face of each of the halves of the housing. The sealing strip serves for affording a seal between a window and a sill of a window frame in which the present invention is mounted. As shown in the Figures, the sealing strip has a depth which is about ⅓ that of the housing.

With continuing reference to FIGS. 1 & 2, a plurality of fan units 24 are each mounted within the interior space of each of the halves in side-by-side relationship along parallel axes. Ideally, three fan units are positioned in each half of the housing and have a height of 3 and ½ inches. Each fan unit includes a first slide switch 26 mounted on a front edge of the top face of the associated halve of the housing. Ideally, the first slide switch is mounted above the corresponding fan unit. In a first orientation, the first slide switch is adapted for directing air from the open front face to the open rear face. In a second orientation, the switch controls the associated fan unit such that air is directed from the open rear face to the open front face. Finally, the flow of air is abated in a third orientation by the demobilization of the fan unit. It should be noted that the open faces may be selectively closed when not in use. This may be accomplished either manually or automatically via door(s) or the like when the present invention is not in use.

Each fan unit further includes a second slide switch 28 adjacent to the first slide switch of the corresponding fan unit, as shown in FIG. 3. The second slide switch serves for controlling a speed at which the fan unit directs air. As shown in FIG. 1, a cord extends from the front edge of one of the halves of the housing for connecting with an electrical receptacle.

Finally, two sets of horizontally oriented vanes 30 are each pivotally mounted between front edges of the end faces of one of the halves of the housing. Each set of vanes includes a lever 32 mounted on the front edge of the outer end face of the corresponding halve of the housing. Such lever is connected to the vanes of the associated set for controlling the flow of air upwardly and downwardly and further precluding the flow of air. In the preferred embodiment, the vanes preferably have a filter 34 mounted on the open front face of the housing. While not shown, a grill or the like is suitably situated over the open rear face of the housing for protection of the fan units and for safety purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air circulator unit with adjustable size comprising, in combination:

a housing including a pair of halves each including a top face, a bottom face and a pair of end faces for defining an interior space, an open front face and an open rear face, the housing further including a length adjuster having a pair of ends coupled to the end faces of the halves of the housing with a plurality of bellows formed therebetween for allowing the movement of the halves along a single axis;

an elastomeric sealing strip mounted along a central extent of the top face, the bottom face and outer end face of each of the halves of the housing for affording a seal between a window and a sill of a window frame;

a plurality of fan units each mounted within the interior space of each of the halves in side-by-side relationship along parallel axes, each fan unit including a first slide switch mounted on a front edge of the top face of the associated halve of the housing above the corresponding fan unit for directing air from the open front face to the open rear face in a first orientation, directing air from the open rear face to the open front face in a second orientation and precluding the flow of air in a third orientation, wherein each fan unit further includes a second slide switch mounted on the front edge of the top face of the associated halve of the housing above the corresponding fan unit for controlling a speed at which the fan unit directs air; and two sets of horizontally oriented vanes each pivotally mounted between front edges of the end faces of one of the halves of the housing, each set of vanes including a lever mounted on the front edge of the outer end face of the corresponding halve of the housing for controlling the flow of air upwardly and downwardly.

2. An air circulator unit with adjustable size comprising:

a housing situated within a window frame and including a pair of halves each defining an interior space, an open front face and an open rear face, the housing further including a length adjuster having a pair of ends coupled between the halves of the housing for allowing the movement of the halves along a single axis; and at least one fan unit each mounted within an interior space of each of the halves for directing air between the open faces.

3. An air circulator unit with adjustable size as set forth in claim 2 wherein a plurality of fan units are situated within each half of the housing in side-by-side relationship.

4. An air circulator unit with adjustable size as set forth in claim 2 wherein each fan unit is independently controlled.

5. An air circulator unit with adjustable size as set forth in claim 2 and further including a sealing strip mounted on the halves of the housing for affording a seal between the housing and a window and a sill of the window frame.

6. An air circulator unit with adjustable size as set forth in claim 2 wherein each half of the housing includes a plurality of horizontally oriented vanes for controlling the flow of air upwardly and downwardly.

7. An air circulator unit with adjustable size as set forth in claim 2 wherein the fan units are each adapted for selectively directing air from the open rear face to the open front face and from the open front face to the open rear face.

8. An air circulator unit with adjustable size as set forth in claim 2 wherein the length adjuster includes a plurality of bellows.

9. An air circulator unit with adjustable size as set forth in claim 2 wherein a plurality of fan units are situated within the housing in side-by-side relationship with each fan unit being independently controlled.

10. An air circulator unit with adjustable size comprising:

a housing positionable in a window frame and including a pair of halves each defining an interior space, an open front face and an open rear face, the housing further including a length adjuster having a pair of ends coupled between the halves of the housing for allowing the movement of the halves along a single axis; and at least one fan unit each mounted in an interior space of each of the halves for directing air between the open faces.

11. An air circulator unit with adjustable size as set forth in claim 10 wherein a plurality of fan units are situated in each half of the housing in side-by-side relationship.

12. An air circulator unit with adjustable size as set forth in claim 10 wherein each fan unit is independently controlled.

13. An air circulator unit with adjustable size as set forth in claim 10 and further including a sealing strip mounted on the halves of the housing.

14. An air circulator unit with adjustable size as set forth in claim 10 wherein each half of the housing includes a plurality of horizontally oriented vanes for controlling the flow of air upwardly and downwardly.

15. An air circulator unit with adjustable size as set forth in claim 10 wherein the fan units are each adapted for selectively directing air from the open rear face to the open front face and from the open front face to the open rear face.

16. An air circulator unit with adjustable size as set forth in claim 10 wherein the length adjuster includes a plurality of bellows.

17. An air circulator unit with adjustable size as set forth in claim 10 wherein a plurality of fan units are situated in the housing in side-by-side relationship with each fan unit being independently controlled.

* * * * *